United States Patent [19]

Bay

[11] 4,117,553

[45] Oct. 3, 1978

[54] HELMET SHIELD AND VISOR APPARATUS

[76] Inventor: William P. Bay, Rte. 1, Box 53, Ormond Beach, Fla. 32974

[21] Appl. No.: 786,900

[22] Filed: Apr. 12, 1977

[51] Int. Cl.[2] ..... A61F 9/00; A42B 1/08

[52] U.S. Cl. ..... 2/10

[58] Field of Search ..... 2/10, 8, 9, 6, 436; 24/208 A, 213; 403/161, 163

[56] References Cited

U.S. PATENT DOCUMENTS

| | | | |
|---|---|---|---|
| 3,168,961 | 2/1965 | Yates | 24/213 R |
| 3,231,300 | 1/1966 | Moroney | 403/163 |
| 3,797,042 | 3/1974 | Gager, Jr. | 2/10 |
| 3,945,044 | 3/1976 | McGee et al. | 2/436 |

FOREIGN PATENT DOCUMENTS

| | | | |
|---|---|---|---|
| 159,047 | 2/1921 | United Kingdom | 2/8 |

*Primary Examiner*—Peter Nerbun

*Attorney, Agent, or Firm*—Duckworth, Hobby, Allen & Pettis

[57] ABSTRACT

A shield and visor combination for snapping onto a helmet includes a visor attachable to a helmet and a shield rotatably attached to the visor and having a center snap for holding the shield in position to cover the face of the wearer. The shield is attached to the visor with a pair of plastic studs each having annular surfaces and an opening in the stud to allow the stud to be compressed against the opening to insert the stud into an opening in the visor. The angled surface then holds the visor in place on the shield, but allows the shield to be rotated or lifted on the visor. The lifted shield will maintain its position by the pressure put against the angled surface of the studs by the shield's bias away from the visor and by a wedging action of the shield against a portion of the visor when the shield is lifted. The shield is a molded polymer having molded support studs, center snap and molded studs for racing peel-off strips.

7 Claims, 5 Drawing Figures

HELMET SHIELD AND VISOR APPARATUS

BACKGROUND OF THE INVENTION

The present invention relates to face shields and visors and especially to motorcycle helmet face shields and visors for attaching to protective helmets and especially to such a face shield visor combination in which the face shield can be lifted and held in different positions.

In the past, a variety of helmets have been designated for use by motorcycle riders, race car drivers, and the like, to protect the head of the user against damage in the event of an accident. The helmets typically provide a male portion of a snap fastener for attaching face shields and/or visors to the helmet. The face shield protects the user of the motorcycle from the wind, rain and the like, when riding the motorcycle, while the visor shades the eyes and face from the sun. The face shield, however, is most likely to become damaged or scratched over a period of time and replaceable face shields as well as visors have been provided by a number of manufacturers for the different helmets which may have differently positioned male snap fastener portions.

The present invention is directed towards a visor and shield combination and is adjustable to fit a variety of safety helmets having studs located in different positions in which the studs for attaching the shield to the visor as well as for attaching racing peel-off strips molded into the shield along with a center snap for holding the shield in position on the visor. The center snap can be quickly unsnapped to allow the raising of the shield and the shield is attached to the visor in a manner that it will hold its position when raised. The prior art has typically provided helmets, visors and shields which have one portion of metal snap fasteners which use female sockets with brass or bronze rings mounted therein which are expensive to purchase and attach to the face shields and visors and which require snap machines as well as employees to operate the snap machines to place the snap fasteners in place. Snap fasteners frequently are attached in slots so that they can be slid in different positions for attaching to helmets. In addition to the additional costs, this results in a number of rejects associated with the snap fastener machinery. In addition, the metal snap fasteners being loosely fitted with ring snaps therein tend to rattle when wind or stresses are put onto the attached face shield. The present invention overcomes these problems by providing molded-in plastic snap fastener portions as well as studs for attaching the shield to the visor for holding the visor in place on the shield. Typical prior art includes not only flip shields but flip shields mounted to bands with rivets for attachment to the helmets. The shield is riveted to the band having female snap portions for engaging with male snap portions on the helmet. Some visor mounted shields use a male square shank post having a head which is inserted through the visor and a screw placed therethrough and tensioned to hold the shield to the visor or band allowing the pivoting up and down. A series of serrations moderately tensioned together has also been suggested along with a tension spring utilizing a common rivet to hold the two units tensioned. All of these units typically require considerable hand labor or complex machine labor in order to assemble the shield to the visor or band, and the parts used for assembly are more costly.

SUMMARY OF THE INVENTION

A helmet shield and visor combination is provided having a visor having openings formed therein as predetermined locations and a visor attachment snap portion for attaching a visor to a helmet. The transparent shield is attached to the visor and mounted to rotate on the visor so that the shield may be lifted when attached to the helmet of a user. The shield is attached to the visor with a pair of polymer studs formed into the shield at predetermined locations, with each stud having an angled surface thereon and an opening therein, so that the stud can be press-fitted through the openings on the visor. The studs have angled surfaces which hold the shield to the visor against the shield bias away from the attached positions creating a force which assists in holding the shield in different positions when raised on the visor. The attachment of the shield to the visor also is such that the shield will wedge against the visor when the shield is lifted with the wedging action increasing the further the shield is lifted to hold the shield in a raised position. A molded center snap portion is molded into the shield and attaches to the visor to hold the shield in its normal position and a tab portion formed in the shield allows the snap to be easily disconnected for raising the shield on the visor. In addition, racing peel-off strip studs are molded into the shield.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
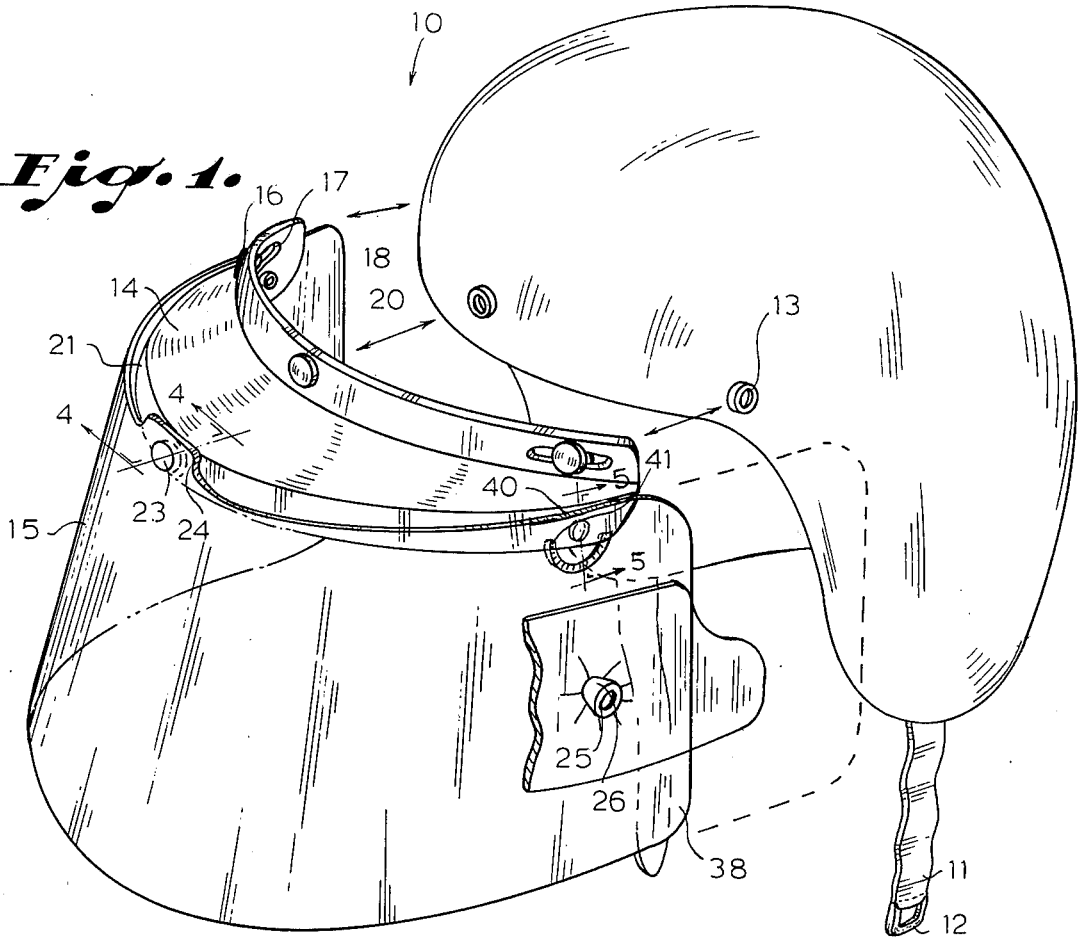
FIG. 1 is an exploded perspective view of a motorcycle helmet having a shield and visor in accordance with the present invention.
Figure 2:
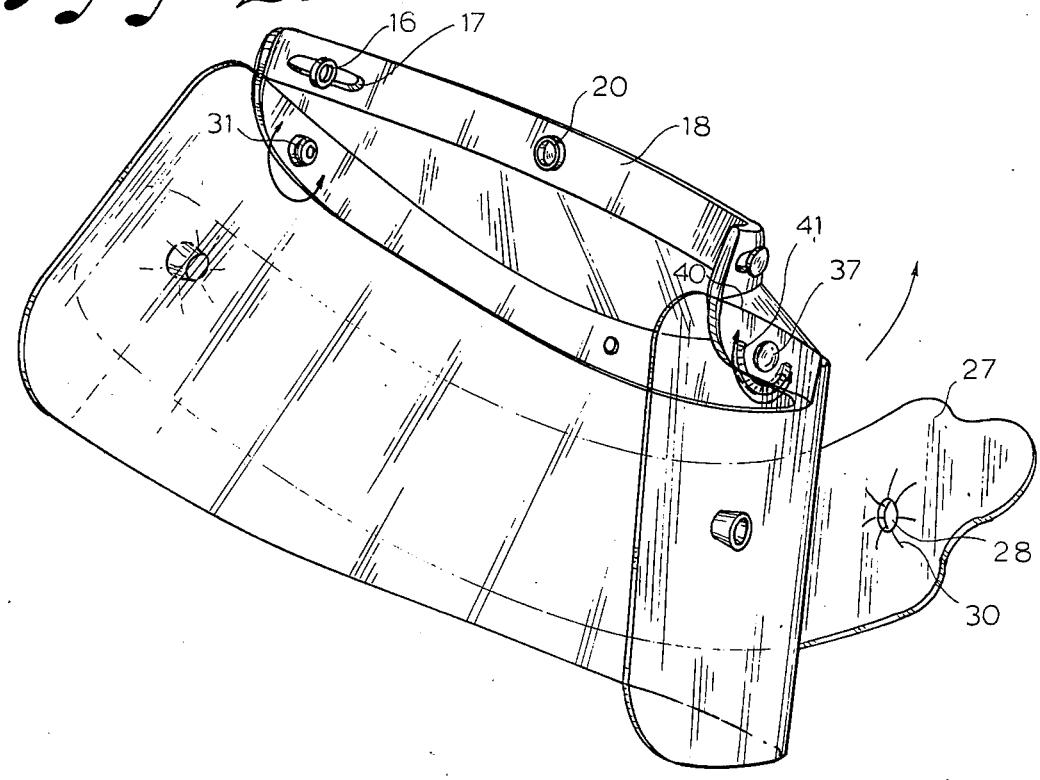
FIG. 2 is a rear side perspective view of a shield and visor of FIG. 1.
Figure 3:
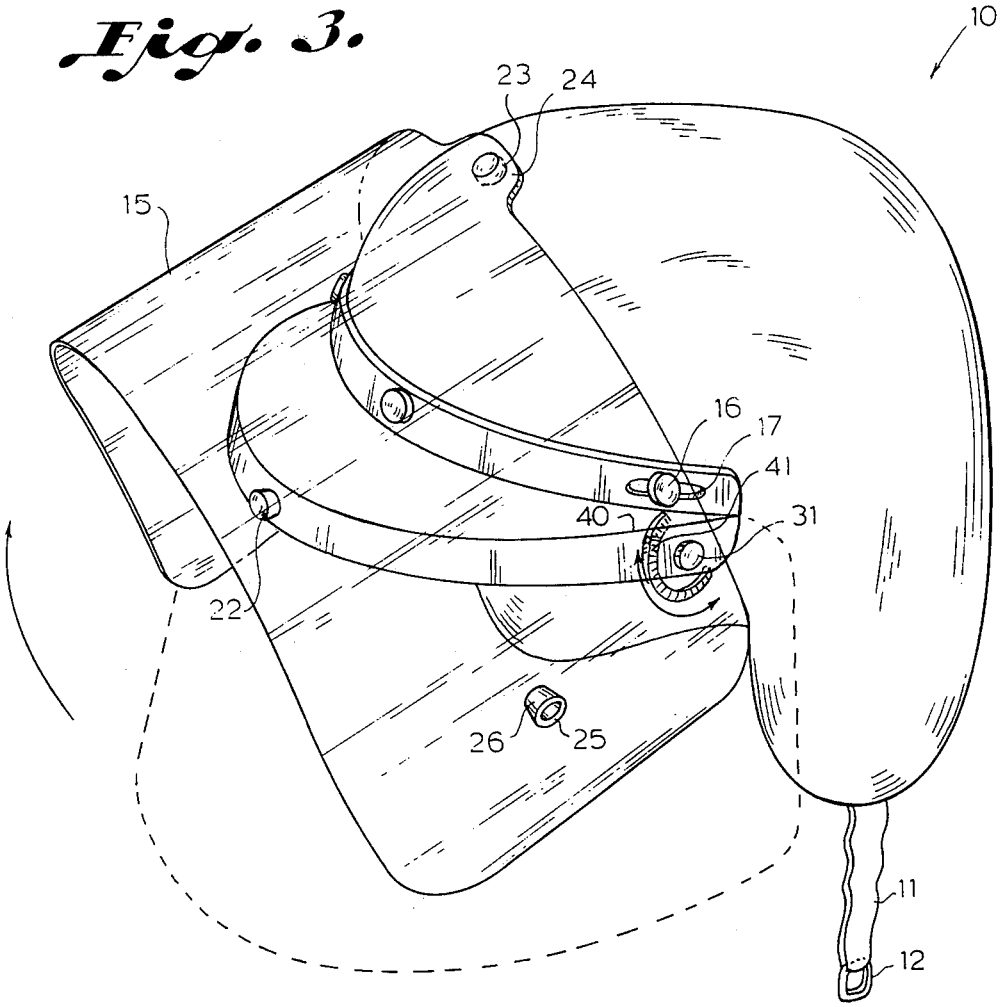
FIG. 3 is a perspective view of a helmet having a shield and visor with the shield raised on the visor.
Figure 4:
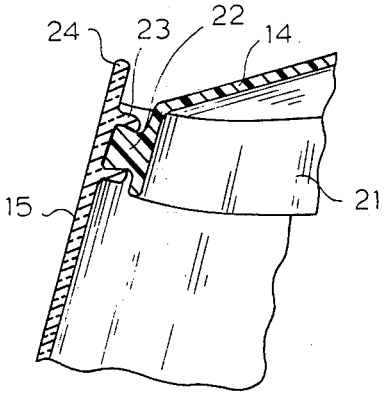
FIG. 4 is a sectional view taken on the line 4—4 of FIG. 1.

Referring now to FIGS. 1 through 5 of the drawings, and especially to FIGS. 1 through 3, a motorcycle helmet 10 is illustrated having a chin strap 11 with a buckle 12 and three male snap fastener portions 13 attached to the helmet. A polymer visor 14 has a transparent polymer shield 15 attached thereto. The visor 14 has a pair of outboard female snap fastener portions 16 mounted in slots 17 of an arcuate support portion of the visor 18. The slots allow the snap fastener portions 16 to slide into different positions for adjusting for different helmets 10, while a center snap fastener portion 20 need not be adjustable, since it is always attached to the center snap fastener portion of the helmet. The visor 14 has a second arcuate surface 21 having a polymer male snap fastener portion 22 shown in FIG. 3 for attachment to a female snap fastener portion 23 which may be molded into the shield 15 to form part of the shield 15. The shield 15 has a raised tab 24 at the position of the female snap portion 23 to allow a finger or a pair of fingers to reach behind the tab 24 and pull the snap fastener portions 23 from the snap fastener portion 22, and raise the shield out of the way of the face when the shield 15 is mounted to the visor 14 and to the helmet 10. The shield 15 has a pair of polymer studs 25 for attaching racing peel-off strips which studs 25 have angled surface 26 for attaching peel-off strips 27 having a pair of openings 28 and a plurality of slits 30 therein. Peel-off strips are used in moto-cross road racing, or the like, where mud and dirt gets splashed upon the shield. One of a plurality of peel-off strips 27 may be pulled off to thereby clear the shield.

Figure 5:
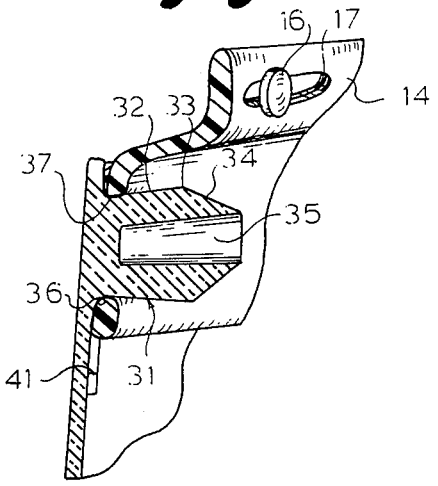
FIG. 5 is a sectional view taken on the line 5—5 of FIG. 1.

The shield 15 is attached to the visor 14 by a pair of polymer studs 31 which are shaped as illustrated in FIG. 5 and formed into the shield 15 and protruding from the shield along an angled surface 32 until it reaches an apex 33 and having an angled portion angling in the opposite direction 34. The stud 31 has a center opening 35 through a portion of the center and may have a camphored edge 36 and protrudes through an opening 37 in a visor 14 arcuate portion 21. Stud 31 is placed through the opening 37 by press-fitting it through the opening inasmuch as the stud 31 will have compressed because of the opening 35 and may be evenly driven against the angled surface 34 when attaching the stud. Once the stud passes through the opening 37, pass the apex 33 of the stud, it then will be supported towards the bottom of the angled surface 32 in the opening 37. This provides a quick attachment means which is firmly held while allowing the shield 15 to be rotated on the visor 14. Inasmuch as the shield 14 tends to straighten out from its curved positioning, it applies a force pulling the stud 31 against the edges of the opening 37 thereby creating a sufficient frictional force such that when the shield 15 is lifted, the force tends to hold the shield in a lifted position. The shield is further held by the free end corner 38 of the shield 15 tending to expand more than the corner having the studs 31. This allows the top edge portion 40 of the shield 15 to wedge against an angled ramp 41 on the shield when the shield is lifted, and to increase the wedging action as the shield is lifted further up, so that the shield is held in place both due to the force applied to the stud 31 against the edges of the opening 37 and by the wedging action of the edge of the shield. The wedging action is caused by the positioning and bias of the shield to the visor and works without the ramp 41 which serves to increase the wedging action. This allows the shield to be held up in different positions without special fasteners or mechanisms.

It should be clear that the shield 15 is molded in one piece with the female snap fastener portion 23 molded thereinto as well as the studs 25 and studs 31, thereby reducing the costs of manufacturing and assembly of the shields. FIG. 3 illustrates the raised shield 15 on the helmet 10 while FIG. 4 has a sectional view illustrating the center snap 23 molded onto the shield 15 and attached to the male snap fastener portion 22, which may be molded onto the visor 14 and may also be a polymer or may be an attached metal snap fastener portion, if desired, without departing from the spirit and scope of the invention. It should also be clear that the press-fitting of the stud 31 into the opening 37 generates a frictional engagement against the rotation of the shield 15 to assist in holding the shield in position.

The cost savings in the present shield permit the use of higher cost polycarbonate resins, or the like, in the manufacture of the shield at the same cost as lower cost resins utilizing high cost metal snaps. It should accordingly, be clear that other embodiments, such as a shield which snaps into holes in a helmet or band, are contemplated as being within the scope of the invention, which is not to be construed as limited to the particular forms as shown herein, which are to be considered illustrative rather than restrictive.

I claim:

1. A helmet shield and visor combination comprising:

a visor having openings formed therein at pre-determined locations;

a visor attachment means for attaching said visor to a helmet;

a transparent shield for attachment to said visor; and shield attachment means for rotatably attaching said shield to said visor, said shield attachment means having a pair of plastic studs formed thereon at pre-determined locations each stud having an angled surface thereon and an opening therein, and adapted to fit into said visor openings, said angled surface being adapted to rotatably hold said shield to said visor, said shield also being formed to bias said angled surfaces on said stud against the edge of said visor openings, said shield attachment means including means to wedge said shield against said visor upon rotation of said visor, whereby said shield is rotatably attached to said visor, so that it may be moved to and held in different positions; and said transparent shield having a center snap fastener portion formed therein for attaching to a snap fastener portion on said visor at a pre-determined location to hold said shield in a pre-determined position on said visor.

2. A shield and visor in accordance with claim 1, in which said shield attachment means polymer studs are integrally formed as a portion of said shield.

3. A shield and visor in accordance with claim 2, in which a pair of studs are molded onto the face of said shield at predetermined locations, to hold peel-off racing strips, said stud having angled surfaces for engaging said peel-off strips.

4. A shield and visor in accordance with claim 2, in which said transparent shield has a tab formed thereon adjacent to said center snap fastener portion for holding said shield.

5. The shield and visor in accordance with claim 1, in which said shield has a pair of ramps formed thereon for wedging against said visor when said transparent shield is moved from its one position to another position for holding said shield in said other position.

6. A shield and visor in accordance with claim 1, in which each of said shield attachment means polymer studs have an annular surface angled from said shield surface to an annular apex.

7. A helmet and shield in accordance with claim 6, in which said shield attachment means polymer studs have a second annular surface angled from said apex to an opening in the center of said stud.

* * * * *